US009360265B2

(12) United States Patent
Pruett et al.

(10) Patent No.: US 9,360,265 B2
(45) Date of Patent: Jun. 7, 2016

(54) MECHANISM FOR DEFEATING ARMOR USING BALLISTIC WEAPONS

(71) Applicant: Raytheon Company, Waltham, MA (US)

(72) Inventors: James A. Pruett, Allen, TX (US); Frank L. Shacklee, Whitesboro, TX (US); David L. Amil, McKinney, TX (US)

(73) Assignee: Raytheon Company, Waltham, MA (US)

( * ) Notice: Subject to any disclaimer, the term of this patent is extended or adjusted under 35 U.S.C. 154(b) by 88 days.

(21) Appl. No.: 13/714,158

(22) Filed: Dec. 13, 2012

(65) Prior Publication Data

US 2016/0097615 A1 Apr. 7, 2016

(51) Int. Cl.
*F41A 19/67* (2006.01)
*F41A 19/02* (2006.01)

(52) U.S. Cl.
CPC ..... *F41A 19/67* (2013.01); *F41A 19/02* (2013.01)

(58) Field of Classification Search
CPC ..... F41A 19/02; F41A 19/67
USPC ..... 89/27.3, 28.05, 28.1, 128, 129.01, 89/129.02, 132, 135, 136
See application file for complete search history.

(56) References Cited

U.S. PATENT DOCUMENTS

| | | | | |
|---|---|---|---|---|
| 2,712,272 | A * | 7/1955 | Trevaskis et al. | 89/136 |
| 2,831,402 | A * | 4/1958 | Taslitt | 89/28.05 |
| 2,972,286 | A * | 2/1961 | Marquardt | 89/126 |
| 2,981,157 | A * | 4/1961 | Marquardt | 89/135 |
| 2,982,183 | A * | 5/1961 | Colby | 89/129.01 |
| 3,440,926 | A | 4/1969 | Gura et al. | |
| 3,451,307 | A * | 6/1969 | Grundberg | 89/129.02 |
| 4,386,848 | A * | 6/1983 | Clendenin et al. | 356/5.01 |
| 5,713,150 | A * | 2/1998 | Ealovega | 42/84 |
| 7,900,622 | B2 * | 3/2011 | Douglas et al. | 124/73 |
| 2004/0020094 | A1 | 2/2004 | Ealovega | |
| 2010/0175547 | A1 * | 7/2010 | Hoffman | 89/9 |

FOREIGN PATENT DOCUMENTS

| | | |
|---|---|---|
| EP | 1 884 735 A1 | 2/2008 |
| FR | 2 089 186 | 1/1972 |
| WO | WO 01/36893 A1 | 5/2001 |

OTHER PUBLICATIONS

Notification of Transmittal of the International Search Report and the Written Opinion of the International Searching Authority, or the Declaration dated Aug. 6, 2014 in connection with International Patent Application No. PCT/US2013/071727.

(Continued)

*Primary Examiner* — Bret Hayes

(57) ABSTRACT

A system includes a ballistic weapon having a barrel and a firing system having a controller. The controller is configured to receive a firing command and in response, when operating in a first mode of operation, to trigger repeated firing of the ballistic weapon such that the barrel of the ballistic weapon reseats in between consecutive firings of the ballistic weapon. The controller may also be configured to receive the firing command and in response, when operating in a second mode of operation, to trigger a single firing of the ballistic weapon. The controller may further be configured to receive the firing command and in response, when operating in a third mode of operation, to trigger repeated firing of the ballistic weapon such that the barrel of the ballistic weapon does not reseat in between consecutive firings of the ballistic weapon.

8 Claims, 4 Drawing Sheets

(56) References Cited

OTHER PUBLICATIONS

"Browning M2 .50 Caliber Machine Gun, Gary's U.S. Infantry Weapons Reference Guide", Dec. 2006, 15 pages.

Screenshots of "Browning Machine Gun" video, made available by National Film and Sound Archive at http://aso.gov.au/titles/sponsored-films/browning-machine-gun/clip1/, Australia, author unknown, date c. 1940, 45 pages.

* cited by examiner

MECHANISM FOR DEFEATING ARMOR USING BALLISTIC WEAPONS

TECHNICAL FIELD

This disclosure is generally directed to ballistic weapons systems. More specifically, this disclosure relates to a mechanism for defeating armor using ballistic weapons.

BACKGROUND

Many vehicles used by military and unconventional forces include armor to protect personnel within the vehicles against ballistic weapons fire. The specific armor on a vehicle is typically designed to protect against ballistic weapons up to a particular caliber. For example, vehicles could include armor designed to withstand multiple 0.50-caliber rounds striking the armor roughly within 120 millimeters of one another.

Ballistic weaponry comes in multiple calibers, and armor used to protect against ballistic weaponry similarly comes in different levels. To defeat armor designed against a certain level of ballistic weaponry, larger or more powerful ballistic weapons can be used. Obviously, this can create a cycle where armor improvements lead to larger-caliber ballistic weapons, requiring additional armor improvements. Another approach to defeating armor involves firing ballistic weapons at a target repeatedly and hoping that a vulnerable location in the armor is struck. Yet another approach to defeating armor involves using a different type of weapon against the armor, such as an energetic weapon. However, it may not be possible or desirable to use larger-caliber ballistic weapons or energetic weapons on some vehicles or in some environments. Also, it may not be possible to fire at a target repeatedly over a long enough period of time to strike a vulnerable location in the armor, assuming there even is a vulnerable location in the armor.

SUMMARY

This disclosure provides a mechanism for defeating armor using ballistic weapons.

In a first embodiment, an apparatus includes a firing system having a controller configured to trigger firing of a ballistic weapon. The ballistic weapon includes a barrel. The controller is configured to operate in at least a first mode of operation. The controller is configured to receive a firing command and in response, when operating in the first mode of operation, to trigger repeated firing of the ballistic weapon such that the barrel of the ballistic weapon reseats in between consecutive firings of the ballistic weapon. The controller may also be configured to receive the firing command and in response, when operating in a second mode of operation, to trigger a single firing of the ballistic weapon. The controller may further be configured to receive the firing command and in response, when operating in a third mode of operation, to trigger repeated firing of the ballistic weapon such that the barrel of the ballistic weapon does not reseat in between consecutive firings of the ballistic weapon.

In a second embodiment, a system includes a ballistic weapon having a barrel and a firing system having a controller configured to trigger firing of the ballistic weapon. The controller is configured to operate in at least a first mode of operation. The controller is configured to receive a firing command and in response, when operating in the first mode of operation, to trigger repeated firing of the ballistic weapon such that the barrel of the ballistic weapon reseats in between consecutive firings of the ballistic weapon. The controller may also be configured to receive the firing command and in response, when operating in a second mode of operation, to trigger a single firing of the ballistic weapon. The controller may further be configured to receive the firing command and in response, when operating in a third mode of operation, to trigger repeated firing of the ballistic weapon such that the barrel of the ballistic weapon does not reseat in between consecutive firings of the ballistic weapon.

In a third embodiment, a method includes receiving, at a firing system, a firing command to fire a ballistic weapon that has a barrel. In response to the firing command, when the firing system is operating in a first mode of operation, the method also includes triggering repeated firing of the ballistic weapon such that the barrel of the ballistic weapon reseats in between consecutive firings of the ballistic weapon. In response to the firing command, when the firing system is operating in a second mode of operation, the method may also include triggering a single firing of the ballistic weapon. In response to the firing command, when the firing system is operating in a third mode of operation, the method may further include triggering repeated firing of the ballistic weapon such that the barrel of the ballistic weapon does not reseat in between consecutive firings of the ballistic weapon.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 6, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

Figure 1:
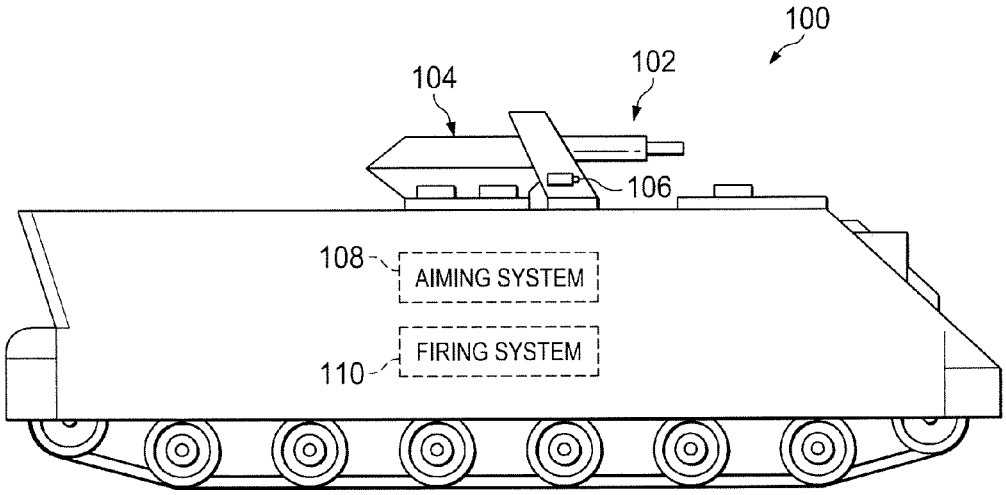
FIG. 1 illustrates an example vehicle containing a ballistic weapon having an "armor defeat" mode of operation in accordance with this disclosure.

FIG. 1 illustrates an example vehicle 100 containing a ballistic weapon having an "armor defeat" mode of operation in accordance with this disclosure. The vehicle 100 generally represents any suitable vehicle that can transport a ballistic weapon. In this example, the vehicle 100 represents a military vehicle, such as a tank or armored personnel carrier. However, any other suitable vehicle could be used here.

As shown in FIG. 1, the vehicle 100 includes a ballistic weapon 102 mounted on a turret 104. The ballistic weapon 102 represents any suitable weapon capable of firing ballistic rounds at one or more targets. In some embodiments, the ballistic weapon 102 represents a 0.50-caliber machine gun, such as a BROWNING M2 machine gun. Note, however, that the ballistic weapon 102 could file other caliber projectiles at one or more targets. As described below, the ballistic weapon 102 can be aimed and triggered by an operator who remains inside the vehicle 100. This can reduce or eliminate the need for an operator to expose himself or herself outside the vehicle 100 when firing the ballistic weapon 102.

The turret 104 represents any suitable structure for moving a ballistic weapon. For example, the turret 104 could rotate 360° to aim the ballistic weapon 102 in any suitable direction. The turret 104 could also elevate the ballistic weapon 102 to aim the ballistic weapon 102 at a target within range of the ballistic weapon 102.

To support the use of the ballistic weapon 102 while an operator is inside the vehicle 100, the vehicle 100 includes one or more cameras 106. The cameras 106 can be used by an operator inside the vehicle 100 to identify enemy targets, aim the ballistic weapon 102, and view damage caused by firing the ballistic weapon 102. The cameras 106 include any suitable structures for generating images of a surrounding environment, such as visible and infrared cameras. The cameras 106 are shown here as being mounted on the ballistic weapon 102, although the camera(s) 106 could be mounted at any other suitable location(s).

The vehicle 100 also includes an aiming system 108. The aiming system 108 is configured to move and aim the ballistic weapon 102. For example, the aiming system 108 could rotate the turret 104 on which the ballistic weapon 102 is mounted to rotate the ballistic weapon 102. The aiming system 108 could also elevate the ballistic weapon 102 to fire on a target that is a specified distance away from the vehicle 100. The aiming system 108 could further perform various calculations, such as elevation, parallax correction, and vehicle/target movement compensation calculations, to aim the ballistic weapon 102 properly for striking a desired target. In some embodiments, the aiming system 108 includes a display device that displays images from the cameras 106 to an operator. This allows the operator to select targets that are to be fired upon by the ballistic weapon 102. The aiming system 108 includes any suitable structure for aiming a ballistic weapon.

The vehicle 100 further includes a firing system 110. The firing system 110 triggers the firing of the ballistic weapon 102. For example, the firing system 110 could send signals to a solenoid or other actuator that pulls the trigger of the ballistic weapon 102. The firing system 110 could also include various failsafes to prevent the accidental firing of the ballistic weapon 102. The firing system 110 includes any suitable structure to control the firing of a ballistic weapon.

In some embodiments, the ballistic weapon 102 could have multiple modes of operation. For instance, the ballistic weapon 102 could operate in a "single fire" mode where a single projectile is fired from the ballistic weapon 102 in response to a single pull of the ballistic weapon's trigger. The ballistic weapon 102 could also operate in a "suppression fire" mode where multiple projectiles are fired from the ballistic weapon 102 in rapid succession in response to a prolonged pull of the ballistic weapon's trigger or in response to multiple rapid pulls of the ballistic weapon's trigger. As noted above, a solenoid or other actuator could be used to physically pull the ballistic weapon's trigger.

With some conventional ballistic weapons such as a 0.50-caliber machine gun, a single shot from a ballistic weapon operating in "single fire" mode can be highly accurate, while multiple shots from the same ballistic weapon operating in "suppression fire" mode can be less accurate. For example, a single shot from a conventional 0.50-caliber machine gun could successfully strike a target approximately 50 mm in diameter at a distance of 100 yards (91.44 meters), while multiple shots may strike within approximately two feet (0.6096 meters) of one another at the same distance. It has been discovered that this lower accuracy is caused by the barrel of the ballistic weapon 102 failing to fully reseat itself between consecutive firings. The failure to reseat means that the barrel of the ballistic weapon 102 is effectively "floating" on its bushings during subsequent firings. This decreases the accuracy of the ballistic weapon 102 greatly (such as by a factor of twelve or even more).

As described in more detail below, the ballistic weapon 102 includes an "armor defeat" mode of operation in which multiple projectiles are fired in rapid succession in response to multiple pulls of the ballistic weapon's trigger. However, the timing of the shots is modified compared to the timing used in "suppression fire" mode. In the "armor defeat" mode, the timing between consecutive shots is increased so that the barrel of the ballistic weapon 102 fully reseats itself. This allows multiple projectiles to be fired from the ballistic weapon 102 with much greater accuracy, allowing the projectiles to strike the armor of a target on top of each other or in very close proximity to each other. By striking the target's armor very close together or on top of one another, rounds of a particular caliber can be used to defeat the target's armor, even when the target's armor is designed to protect against that caliber of round or against even larger caliber rounds. Note that the ballistic weapon 102 can fire any number of projectiles while in "armor defeat" mode, and this number could be defined or adjusted by the operator. Additional details regarding the "armor defeat" mode of operation are provided below.

Although FIG. 1 illustrates one example of a vehicle 100 containing a ballistic weapon 102 having an "armor defeat" mode of operation, various changes may be made to FIG. 1. For example, a land-based vehicle is not necessarily required for use with a ballistic weapon 102 having an "armor defeat" mode of operation. A ballistic weapon with an "armor defeat" mode of operation could be mounted on any other suitable platform, be mounted in a stationary location, or be portable and used in multiple locations. As particular examples, a ballistic weapon with an "armor defeat" mode could be used with a remote-controlled Unmanned Land Vehicle (ULV), a ship, boat, a remote-controlled Unmanned Water Vehicle (UWV), a helicopter, an airplane, or a remote-controlled Unmanned Aerial Vehicle (UAV). Also, the ballistic weapon 102 could include any number of operating modes so long as one mode of operation is the "armor defeat" mode.

Figure 2:
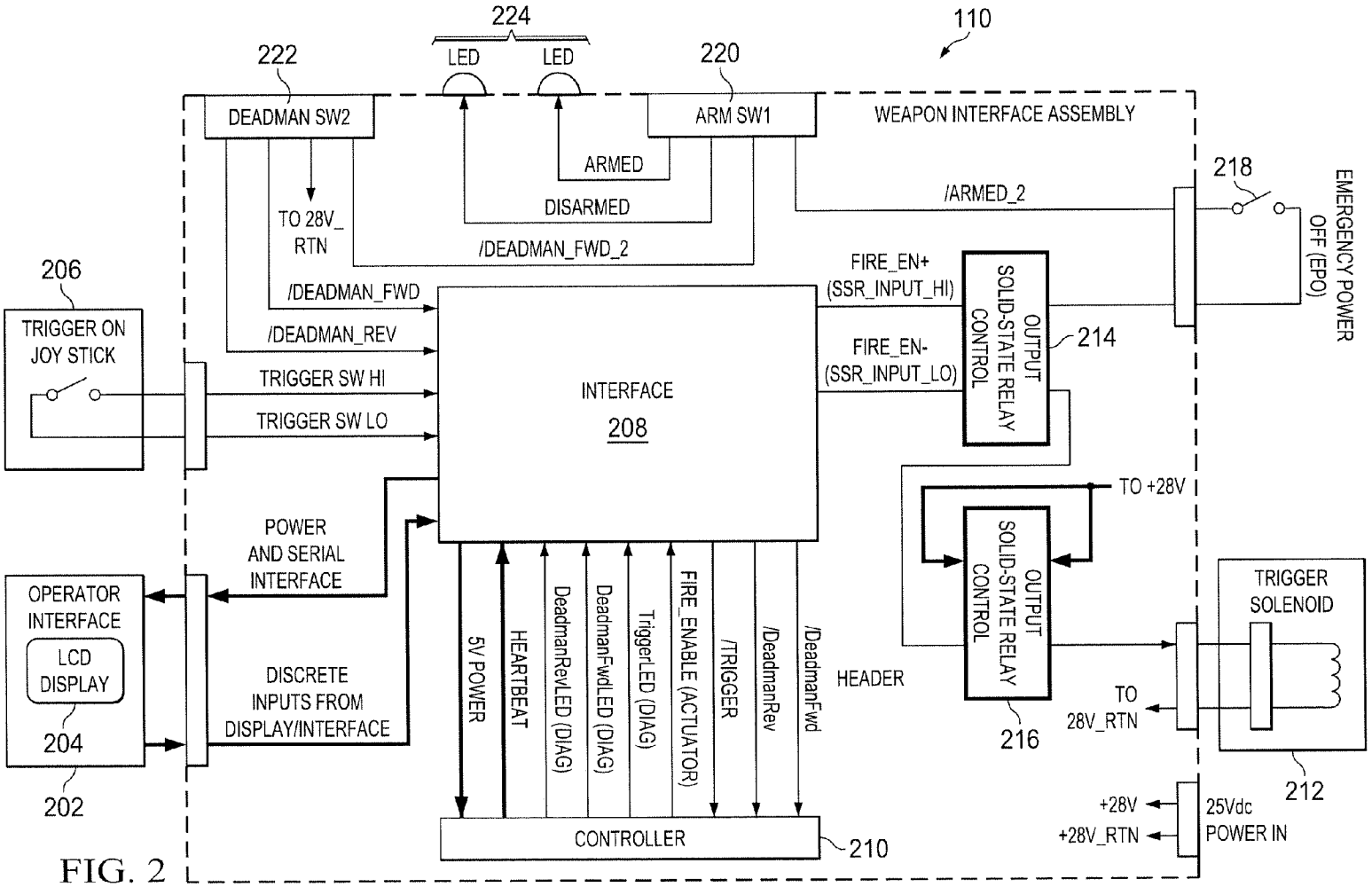
FIG. 2 illustrates an example firing system for a ballistic weapon having an "armor defeat" mode of operation in accordance with this disclosure.

FIG. 2 illustrates an example firing system 110 for a ballistic weapon having an "armor defeat" mode of operation in accordance with this disclosure. For ease of explanation, the firing system 110 is described as being used to fire the ballistic weapon 102 on the vehicle 100. However, the firing system 110 could be used with any other suitable ballistic weapon in any location or on any platform.

As shown in FIG. 2, the firing system 110 includes or is coupled to an operator interface 202 having a display device 204. The operator interface 202 includes various components for providing user input to the firing system 110, such as controls for defining whether the ballistic weapon 102 is to be fired in "single fire," "suppression fire," or "armor defeat" mode and the number of rounds to be fired when in "armor defeat" mode. The operator interface 202 includes any suitable structure for providing input to a firing system. The display device 204 presents images and information to an operator, such as images from the camera 106. The display device 204 includes any suitable structure for presenting visual information to an operator, such as a liquid crystal display (LCD) device. In some embodiments, the display device 204 is used to support a Commander's Independent Viewer (CIV).

The firing system 110 also includes or is coupled to a joystick 206. The joystick 206 can be used by an operator to provide input to the aiming system 108, where the joystick 206 defines where the operator wishes to aim the ballistic weapon 102. The joystick 206 also includes a trigger (either physical or virtual) that provides input to the firing system 110, such as a firing command indicating when the operator wishes to fire the ballistic weapon 102. The joystick 206 includes any suitable structure for receiving operator input regarding the aiming and firing of a ballistic weapon.

An interface 208 supports communication and data exchange among various components of the firing system 110. For example, the interface 208 could provide power to the operator interface 202 and data to be presented on the display device 204. The interface 208 could also receive signals indicating when the trigger of the joystick 206 is depressed. The interface 208 further supports data exchange with a controller 210 and other components. The interface 208 includes any suitable structure supporting interaction between other devices of a firing system.

The controller 210 controls the overall operation of the firing system 110. For example, the controller 210 could detect when the firing of the ballistic weapon 102 is enabled and when the trigger of the joystick 206 has been depressed. The controller 210 could then generate signals for controlling the operation of an actuator 212 that triggers the firing of the ballistic weapon 102. The controller 210 could perform various other operations, such as disabling the firing of the ballistic weapon 102 and controlling various light emitting diodes (LEDs) or other visual indicators. The controller 210 includes any suitable structure for controlling the firing of a ballistic weapon, such as a microprocessor, microcontroller, or other processing or control device. The actuator 212 includes any suitable structure for firing a ballistic weapon, such as a solenoid that depresses and releases the trigger of the ballistic weapon.

In this example, two relays 214-216 provide firing signals from the controller 210 (via the interface 208) to the actuator 212. The relay 214 can prevent the firing signals from reaching the actuator 212 in response to input from an emergency shutoff switch 218, and the relay 216 passes the firing signals to the actuator 212 when power is being received by the firing system 110. This provides a safety feature since the ballistic weapon 102 cannot be fired unless power is being received and the emergency shutoff switch 218 has not been triggered. The relays 214-216 include any suitable structures for passing or blocking signals, such as solid-state relays.

Various switches are used in the firing system 110 to provide additional safety features. For example, a switch 220 can be used by an operator to manually arm and disarm the firing system 110. The switch 220 could also disarm the firing system 110 in response to a signal from the emergency shutoff switch 218. A "dead man" switch 222 represents a switch that automatically disarms the firing system 110 when an operator releases the switch 222. The switch 222 could be separate or integrated into another device, such as the joystick 206. When disarmed, the firing system 110 cannot trigger the ballistic weapon 102 via the actuator 212. In this embodiment, the ballistic weapon 102 can only be triggered when the operator manually toggles the switch 220 and is depressing the switch 222. Each switch 220-222 includes any suitable structure for changing states to arm or disarm a firing system.

Two LEDs 224 here provide a visual indication to the operator whether the firing system 110 is armed or disarmed. For example, a green LED could indicate that the firing system 110 is disarmed, and a red LED could indicate that the firing system 110 is armed. Note that the use of LEDs 224 is optional since other indicators, such as on the display device 204, could be used to identify the armed/disarmed status of the firing system 110.

As noted above, the ballistic weapon 102 could have different modes of operation. The current mode of operation could be selected by an operator, such as via a switch or other input mechanism in the operator interface 202. In the "single fire" mode, the controller 210 causes the actuator 212 to trigger the ballistic weapon 102 in order to fire a single projectile. In the "suppression fire" mode, the controller 210 causes the actuator 212 to trigger the ballistic weapon 102 in order to fire multiple projectiles rapidly. In the "armor defeat" mode, the controller 210 causes the actuator 212 to trigger the ballistic weapon 102 multiple times in order to fire multiple projectiles. However, in the "armor defeat" mode, the controller 210 controls the timing between consecutive firings so that there is adequate time for the barrel of the ballistic weapon 102 to reseat. As a result, in the "armor defeat" mode, the ballistic weapon 102 fires multiple projectiles with very high accuracy.

Note that in all three operating modes, an operator may only depress the trigger on the joystick 206 once to generate a firing command for firing the ballistic weapon 102, even if the controller 210 translates that firing command into multiple physical pulls on the ballistic weapon's trigger. For example, in "single fire" mode, the operator may depress the trigger on the joystick 206 once and quickly release the trigger. In "suppression fire" mode, the operator may depress the trigger on the joystick 206 once and keep the trigger depressed for as long as the operator wishes to fire the ballistic weapon 102. In "armor defeat" mode, the operator may depress the trigger on the joystick 206 once and keep the trigger depressed in order to cause the controller 210 to fire the ballistic weapon 102 repeatedly for a user-defined or other number of times.

Although FIG. 2 illustrates one example of a firing system 110 for a ballistic weapon 102 having an "armor defeat" mode, various changes may be made to FIG. 2. For example, other or additional safety mechanisms could be used to arm or disarm the firing system 110 or the ballistic weapon 102. Also, any other or additional mechanism(s) could be used to provide information to an operator or receive information from an operator.

When operating in "armor defeat" mode, the ballistic weapon 102 has adequate time to reseat its barrel between consecutive shots. Also, the ballistic weapon 102 is fired rapidly in succession. With the ability to fire repeatedly but with improved accuracy, multiple projectiles can be fired from the ballistic weapon 102 and strike a target very close together. This enables the ballistic weapon 102 to defeat the target's armor in one or several ways.

Figure 3A:
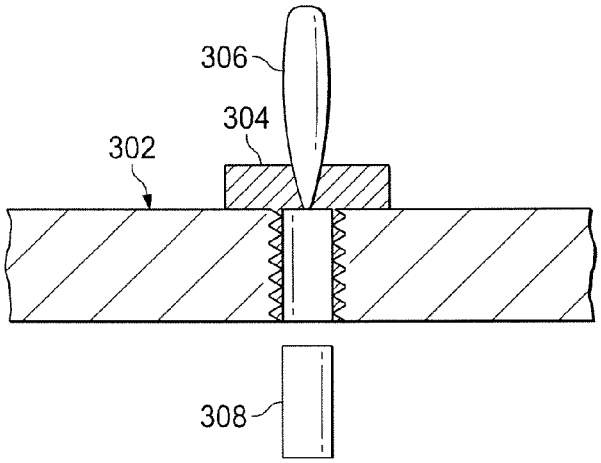
FIGS. 3A through 3C illustrate a first example technique for defeating armor in accordance with this disclosure.
Figure 3B:
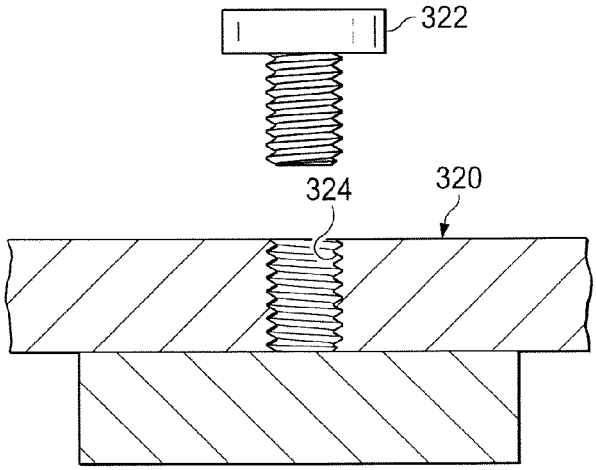
Figure 3C:
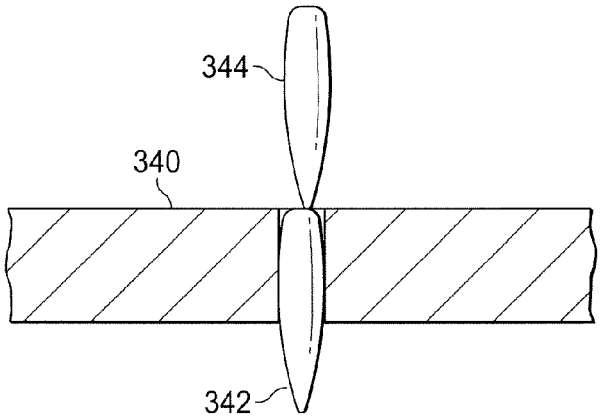

FIGS. 3A through 3C illustrate a first example technique for defeating armor in accordance with this disclosure. As shown in FIG. 3A, a known weakness in armor occurs when armor 302 includes a bolt 304 that extends completely through the armor 302. If a projectile 306 strikes the head of the bolt 302, the projectile 306 can dislodge the body 308 of the bolt 302. The body 308 of the bolt 302 can then become a projectile itself, injuring or killing occupants or damaging internal components of a vehicle. FIG. 3B shows a standard way of avoiding this problem, where armor 320 receives a bolt 322 in a blind receptacle 324. This can reduce or eliminate the likelihood that a projectile striking the bolt 322 will cause the body of the bolt 322 to act as a projectile inside a vehicle.

Given this knowledge, one mechanism for defeating armor using the ballistic weapon 102 in "armor defeat" mode is shown in FIG. 3C. Here, given the improved accuracy of the ballistic weapon 102 in "armor defeat" mode, armor 340 can be struck by a first projectile 342, and a second projectile 344 can then strike the first projectile 342. Effectively, the second projectile 344 "pile drives" the first projectile 342 through the armor 340, allowing one or both projectiles 342-344 to pass through the armor 340.

Figure 4:
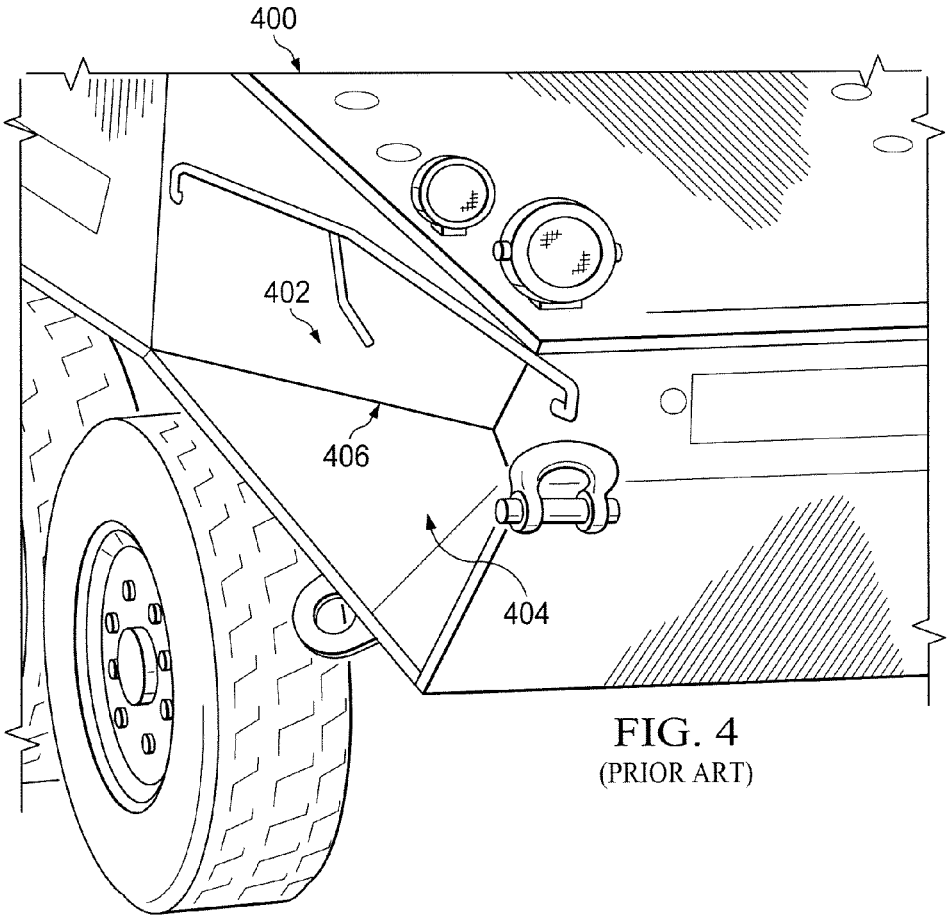
FIG. 4 (PRIOR ART)
FIG. 4 illustrates a second example technique for defeating armor in accordance with this disclosure.

FIG. 4 illustrates a second example technique for defeating armor in accordance with this disclosure. As shown in FIG. 4, an armored vehicle 400 includes multiple armored plates 402-404 separated by a seam 406. The seam 406 represents a small gap between the plates 402-404. The presence of this seam 406 is typically viewed as being acceptable because standard machine guns or other ballistic weapons lack the ability to rapidly direct multiple projectiles precisely into the seam 406.

With the improved accuracy of the ballistic weapon 102 operating in "armor defeat" mode, it is possible for the ballistic weapon 102 to rapidly fire multiple projectiles into the area where a seam 406 is located. This may allow one or multiple projectiles to pass through the seams 406 and defeat the vehicle's armor.

Figure 5:
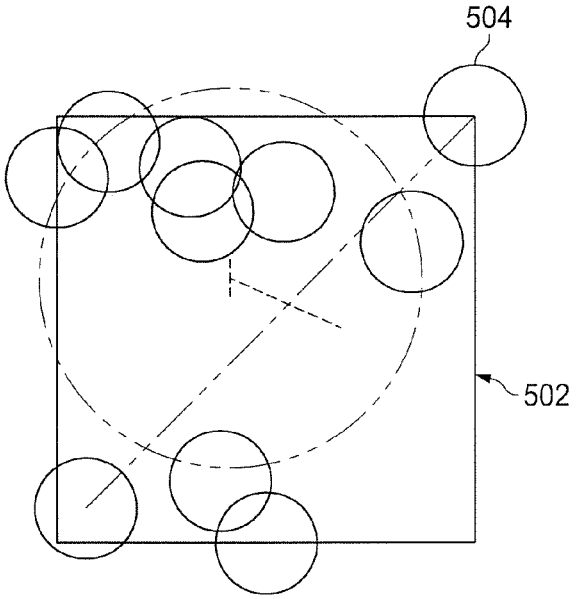
FIG. 5 illustrates a third example technique for defeating armor in accordance with this disclosure.

FIG. 5 illustrates a third example technique for defeating armor in accordance with this disclosure. In particular, FIG. 5 illustrates the accuracy of a large number of projectiles fired from the ballistic weapon 102 operating in "armor defeat" mode at a range of 100 yards (91.44 meters). In FIG. 5, a rectangular area 502 denotes an area that is about 2.049 inches (52.04 mm) in width and about 2.754 inches (69.95 mm) in height. Each small circle 504 denotes the impact point of projectile.

As can be seen in FIG. 5, the "armor defeat" mode allows a large number of projectiles to strike armor in a very small area. Armor is typically designed to withstand multiple projectiles striking the armor but with a wider spread in a larger area. By striking the armor repeatedly within a smaller area (such as within an area about 90 mm, 80 mm, 70 mm, 60 mm, 50 mm, or less in width), the ballistic weapon 102 can weaken the armor in that area and then punch through the armor in the weakened area, thereby defeating the armor. This can occur even if the projectiles do not land on top of each other.

As shown in FIGS. 3A through 5, operating a ballistic weapon in "armor defeat" mode (where the weapon barrel reseats between shots) provides various ways in which armor on a target can be defeated. The armor can be defeated even though the armor is designed for the specific caliber of projectile being fired by the ballistic weapon, possibly even for larger caliber projectiles. For instance, a 0.50-caliber machine gun could use the "armor defeat" mode to defeat armor that is specifically designed to protect against 0.50-caliber projectiles or even to defeat armor that is designed to protect against projectiles larger than 0.50-caliber.

Although FIGS. 3A through 5 illustrate examples of techniques for defeating armor, various changes may be made to FIGS. 3A through 5. For example, these figures are meant merely to illustrate different ways in which a ballistic weapon in "armor defeat" mode could defeat armor. A ballistic weapon operating in "armor defeat" mode could defeat armor in any suitable manner, including these or other techniques or a combination of these or other techniques.

Note that various other features could be used in combination with a ballistic weapon that can operate in "armor defeat" mode. For example, the vehicle 100 could provide a CIV display that remains active even when the ballistic weapon 102 is being fired. This may allow, for instance, an operator to adjust the aim of the ballistic weapon 102 during firing to track the movement of a target. As another example, the vehicle 100 could support the use of a Multi-Function Radio Frequency System (MFRFS) to track outgoing projectiles, which can reduce or eliminate the need for tracer rounds. Any other or additional functions could be used in combination with a ballistic weapon that can operate in "armor defeat" mode.

Figure 6:
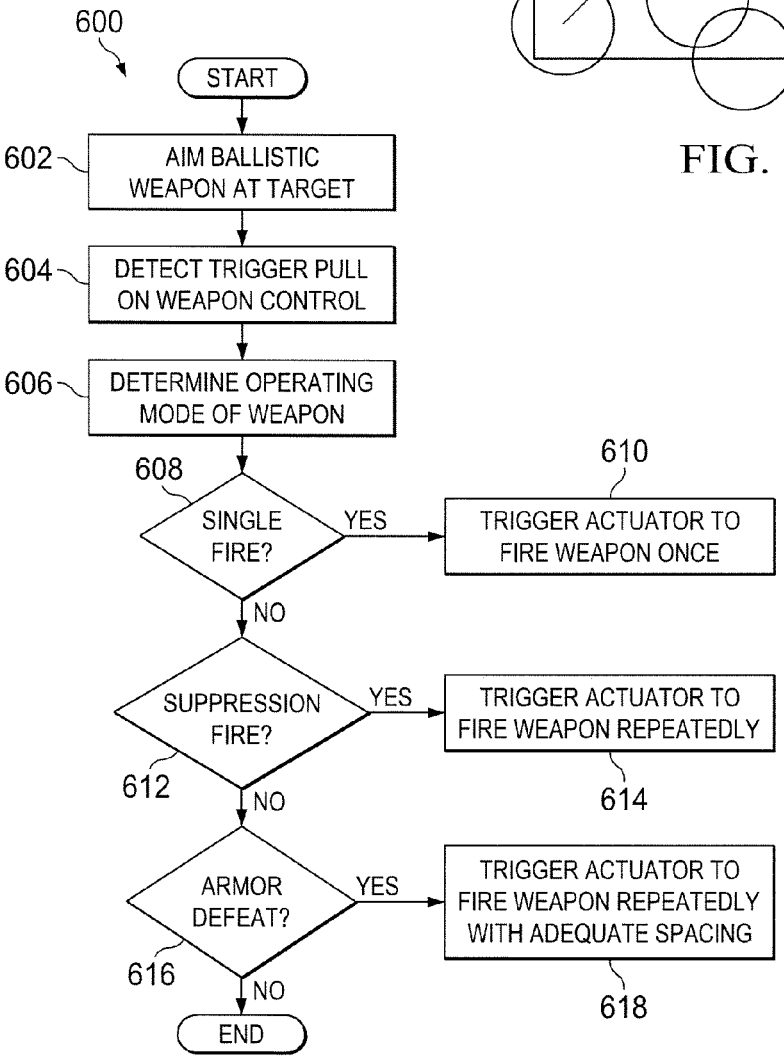
FIG. 6 illustrates an example method for defeating armor using a ballistic weapon in accordance with this disclosure.

FIG. 6 illustrates an example method 600 for defeating armor using a ballistic weapon in accordance with this disclosure. As shown in FIG. 6, a ballistic weapon is aimed at a target at step 602. This could include, for example, an operator viewing images from the camera 106 and using the joystick 206 to identify a desired target. This could also include the aiming system 108 performing elevation, parallax correction, vehicle/target movement compensation, or other calculations to determine where the ballistic weapon 102 should be pointed in order to fire on the desired target. This could further include the aiming system 108 causing a turret 104 or other structure to move and elevate the ballistic weapon 102 so that the ballistic weapon 102 is pointed in the correct direction.

A trigger pull on a weapon control is detected at step 604. This could include, for example, the controller 210 detecting the depression of a trigger on the joystick 206 through the receipt of a firing command. The operating mode of the ballistic weapon is identified at step 606. This could include, for example, the controller 210 determining whether the ballistic weapon 102 is set to operate in "single fire," "suppression fire," or "armor defeat" mode.

If the ballistic weapon 102 is set to operate in "single fire" mode at step 608, an actuator is triggered to fire the ballistic weapon once at step 610. This could include, for example, the controller 210 causing the actuator 212 to pull the trigger of the ballistic weapon 102 once and then quickly release the trigger. This fires the ballistic weapon once, and the ballistic weapon can fire the single projectile with its normally high accuracy.

If the ballistic weapon 102 is set to operate in "suppression fire" mode at step 612, the actuator is triggered to fire the ballistic weapon repeatedly at step 614. This could include, for example, the controller 210 causing the actuator 212 to pull the trigger of the ballistic weapon 102 once and keep the trigger depressed for a prolonged period of time (such as until an operator releases a trigger on the joystick 206). This fires the ballistic weapon 102 multiple times in rapid succession. In this mode, the ballistic weapon 102 may fire while its barrel is floating on its bushings, which can decrease the accuracy of the ballistic weapon 102. However, the decrease in accuracy is typically acceptable in this mode of operation.

If the ballistic weapon 102 is set to operate in "armor defeat" mode at step 616, the actuator is triggered to fire the ballistic weapon repeatedly (but with adequate spacing between shots) at step 618. This could include, for example, the controller 210 causing the actuator 212 to pull the trigger of the ballistic weapon 102 multiple times in rapid succession. However, the time between trigger pulls is selected so that the barrel of the ballistic weapon 102 reseats between shots. This can greatly increase the accuracy of the ballistic weapon 102, allowing the ballistic weapon 102 to more easily defeat armor on the target.

Note that the specific timing between shots in "armor defeat" mode can vary depending on the specific ballistic weapon being controlled. The timing can therefore be selected based on how much time is needed for the barrel of the ballistic weapon to reseat after firing. This can be determined in any suitable manner, such as by capturing images of a ballistic weapon during firing, or by using different timing parameters and determining when shots from the ballistic weapon become more accurate.

Although FIG. 6 illustrates one example of a method 600 for defeating armor using a ballistic weapon, various changes may be made to FIG. 6. For example, the controller 210 need not check in series whether the ballistic weapon is set to operate in "single fire," "suppression fire," or "armor defeat" mode. Steps 608-618 are merely meant to illustrate that different modes of operation result in different firing patterns by the ballistic weapon. Moreover, any suitable action could take place if the "no" path is followed from step 616. For instance, the controller 210 could fire the ballistic weapon in some other mode of operation or not fire the ballistic weapon. In addition, while shown as a series of steps, various steps in FIG. 6 could overlap, occur in parallel, occur in a different order, or occur multiple times.

In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method comprising:

receiving, at a firing system, a firing command to fire a ballistic weapon that comprises a barrel; and in response to the firing command, when the firing system is operating in a first mode of operation, triggering repeated firing of the ballistic weapon at a specified timing by triggering firing of a first round, waiting for the barrel of the ballistic weapon to reseat after firing, and triggering firing of a second round after the barrel has reseated.

2. The method of claim 1, further comprising:

in response to the firing command, when the firing system is operating in a second mode of operation, triggering a single firing of the ballistic weapon.

3. The method of claim 2, further comprising:

in response to the firing command, when the firing system is operating in a third mode of operation, triggering repeated firing of the ballistic weapon such that the barrel of the ballistic weapon does not reseat in between consecutive firings of the ballistic weapon.

4. The method of claim 1, further comprising:

firing the ballistic weapon so that projectiles strike a target within an area that is about 90 mm or less in width.

5. The method of claim 1, further comprising:

firing the ballistic weapon so that projectiles strike a target on top of one another.

6. The method of claim 1, further comprising:

firing the ballistic weapon and directing projectiles towards a seam in armor of a target.

7. The method of claim 1, further comprising:

firing the ballistic weapon without firing tracer rounds; and using a multi-function radio frequency system (MFRFS) to track outgoing rounds.

8. The method of claim 1, further comprising:

selecting the specified timing between consecutive firings of the ballistic weapon based on how much time is needed for the barrel to reseat after firing.

* * * * *